US005913791A

United States Patent [19]

Baldwin

[11] Patent Number: 5,913,791

[45] Date of Patent: Jun. 22, 1999

[54] BUILDING BLOCK, METHOD FOR MAKING THE SAME, AND METHOD FOR BUILDING A WALL USING THE SAME

[76] Inventor: Robert A. Baldwin, 17440 N. Tatum, #327, Phoenix, Ariz. 85032

[21] Appl. No.: 08/852,922

[22] Filed: May 8, 1997

[51] Int. Cl.[6] ..... E04C 1/40

[52] U.S. Cl. ..... 52/612; 52/422; 52/437; 52/605; 52/607

[58] Field of Search ..... 52/605, 606, 607, 52/612, 422, 437, 439; 106/677, 675; 428/339

[56] References Cited

U.S. PATENT DOCUMENTS

| | | | |
|---|---|---|---|
| 729,918 | 6/1903 | Braun . | |
| 1,411,005 | 3/1922 | Dula . | |
| 1,582,735 | 4/1926 | Cooper . | |
| 1,683,441 | 9/1928 | Bone . | |
| 2,185,497 | 1/1940 | Cilento et al. | 52/610 |
| 2,701,959 | 2/1955 | Briggs | 72/42 |
| 2,706,109 | 4/1955 | Odman | 263/51 |
| 2,751,775 | 6/1956 | Sergovic | 72/35 |
| 2,805,448 | 9/1957 | Rubenstein | 18/60 |
| 2,817,619 | 12/1957 | Bickel, et al. | 154/110 |
| 2,951,001 | 8/1960 | Rubenstein | 154/45.9 |
| 3,194,724 | 7/1965 | Sergovic | 161/158 |
| 4,001,988 | 1/1977 | Riefler | 52/125 |
| 4,285,179 | 8/1981 | Goidinger | 52/606 |
| 4,295,313 | 10/1981 | Rassias | 52/438 |
| 4,306,395 | 12/1981 | Carpenter | 428/327 |
| 4,319,440 | 3/1982 | Rassias, et al. | 52/438 |
| 4,518,431 | 5/1985 | Duvier, Jr. | 52/612 |
| 4,573,301 | 3/1986 | Wilkinson | 52/607 |
| 4,831,802 | 5/1989 | Cromrich et al. | 52/311 |
| 5,143,670 | 9/1992 | De Buzzaccarini | 264/256 |
| 5,231,813 | 8/1993 | Drawdy | 52/309.12 |
| 5,268,226 | 12/1993 | Sweeney | 428/339 |
| 5,308,396 | 5/1994 | Kovacs | 106/677 |
| 5,379,565 | 1/1995 | Vienne | 52/606 |

FOREIGN PATENT DOCUMENTS

| | | |
|---|---|---|
| 132021 | 4/1949 | Australia . |
| 143687 | 10/1951 | Australia . |

*Primary Examiner*—Michael Safavi

*Attorney, Agent, or Firm*—Martin & Associates, L.L.C.; Derek P. Martin

[57] ABSTRACT

A building block has a cement-based attachment layer on one or both exterior surfaces of the block that receives and holds a penetrating fastener such as a nail, screw, staple, or the like. This allows surficial coverings such as wallboard, siding or other materials to be easily attached to a block wall made of the building blocks. The block includes substantially semi-cylindrical concave portions that form a cross-linked structure of channels when the blocks are assembled into a wall. Once the blocks have been stacked in place in a wall, grout or other suitable filling material is poured into the cross-linked structure of channels. When the filling material hardens, the blocks are locked together. Surficial covering materials may then be nailed, screwed, or stapled directly to the attachment layer of the blocks.

17 Claims, 5 Drawing Sheets

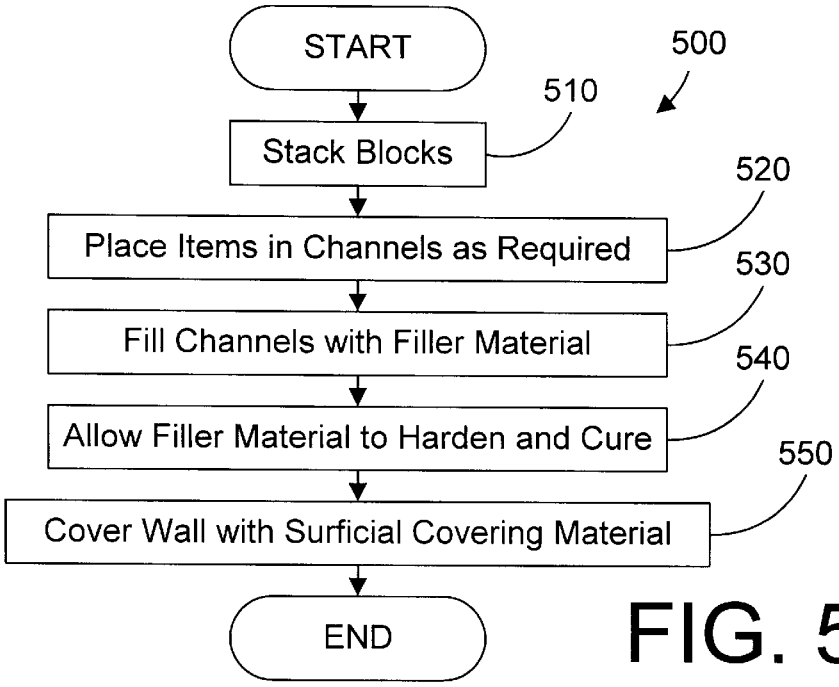
FIG. 5
FIG. 8
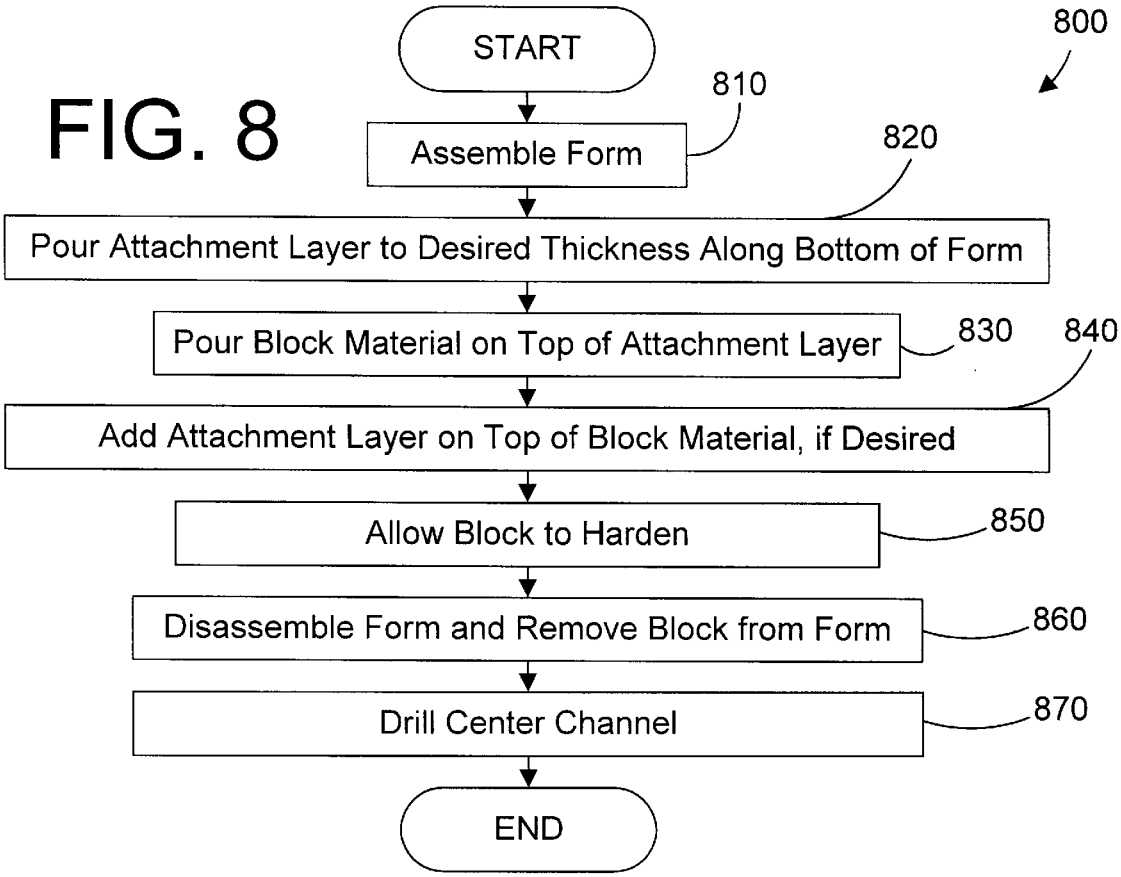

BUILDING BLOCK, METHOD FOR MAKING THE SAME, AND METHOD FOR BUILDING A WALL USING THE SAME

BACKGROUND OF THE INVENTION

1. Technical Field

This invention generally relates to construction materials and techniques, and more specifically relates to a building block, a method for making the building block, and a method for building a wall using the building block.

2. Background Art

Building blocks have been used for centuries to construct homes, office buildings, churches, and many other structures. Early building blocks were hewn from stone into appropriate shapes that were assembled together, typically using mortar, to form a wall. In modern times, various types of concrete blocks were developed, which are typically formed by pouring a cement mixture into a form and allowing the cement to harden. This type of cement block is strong and makes for a sturdy wall, but installing a traditional concrete block requires a skilled mason that places mortar in all joints between blocks to secure the blocks in place.

Various different block configurations have been developed that allow mortar to be poured into inner passageways of the blocks once the blocks have been constructed into a wall. Some of these eliminate the need for a mason to apply mortar between the blocks as the blocks are laid because the blocks are interlocked using mortar poured into interior passages. Examples of blocks with inner passages are found in U.S. Pat. No. 4,295,313, "Building Blocks, Wall Structures Made Therefrom, and Methods of Making the Same", issued Oct. 20,1981 to Rassias; U.S. Pat. No. 4,319,440, "Building Blocks, Wall Structures Made Therefrom, and Methods of Making the Same", issued Mar. 16, 1982 to Rassias; U.S. Pat. No. 2,701,959, "Sectional Block Masonry", issued Feb. 15,1955 to Briggs; and Swiss Patent No. 354237, issued Jun. 30,1961.

One significant drawback of using concrete blocks to form walls in a structure is that surficial covering material often needs to be applied to the surface of the walls. Many common surficial coverings for walls are attached using nails or screws. For example, siding may need to be applied to the outside of the wall, and wallboard, paneling, or other sheet material may need to be applied to the inside of the wall. Known concrete blocks are too hard and brittle to allow commonly-used nails or screws to be used to attach a surficial covering material. As a result, special concrete nails or anchors are typically used to secure wood furring strips or studs to the concrete block wall, and the covering materials are, in turn, fastened to the furring strips or studs. This process of fastening wood furring strips or studs to the block wall and nailing on the covering material to the furring strips is time-consuming, and the concrete blocks do not hold the nails or anchors in place very well. It is not uncommon for one or more of the concrete nails to become loose when a surficial material is nailed in place, compromising the structural integrity of the wall.

Therefore, there existed a need to provide an improved building block with an attachment layer that allows covering materials to be directly attached to the building blocks using conventional nails, screws, or staples.

DISCLOSURE OF INVENTION

According to the present invention, a building block has a cement-based attachment layer on one or both exterior surfaces of the block that receives and holds a penetrating fastener such as a nail, screw, staple, or the like. This allows surficial coverings such as wallboard, siding or other materials to be easily attached to a block wall made of the building blocks. The block includes substantially semi-cylindrical concave portions that form a cross-linked structure of channels when the blocks are assembled into a wall. Once the blocks have been stacked in place in a wall, grout or other suitable filling material is poured into the cross-linked structure of channels. When the filling material hardens, the blocks are locked together. Surficial covering materials may then be nailed, screwed, or stapled directly to the attachment layer of the blocks.

The foregoing and other features and advantages of the invention will be apparent from the following more particular description of preferred embodiments of the invention, as illustrated in the accompanying drawings.

BRIEF DESCRIPTION OF DRAWINGS

The preferred embodiments of the present invention will hereinafter be described in conjunction with the appended drawings, where like designations denote like elements, and:

FIG. 5 is a flow diagram of a method for building a wall in accordance with the preferred embodiments using the block of FIG. 1;

FIG. 8 is a flow diagram of a method for forming the block of FIG. 1.

BEST MODE FOR CARRYING OUT THE INVENTION

The building block of the present invention allows any suitable material to be directly fastened (e.g., screwed, nailed, or stapled) to it. An attachment layer on the block is formulated to provide the required penetration and holding characteristics for the fasteners.

Figure 1:
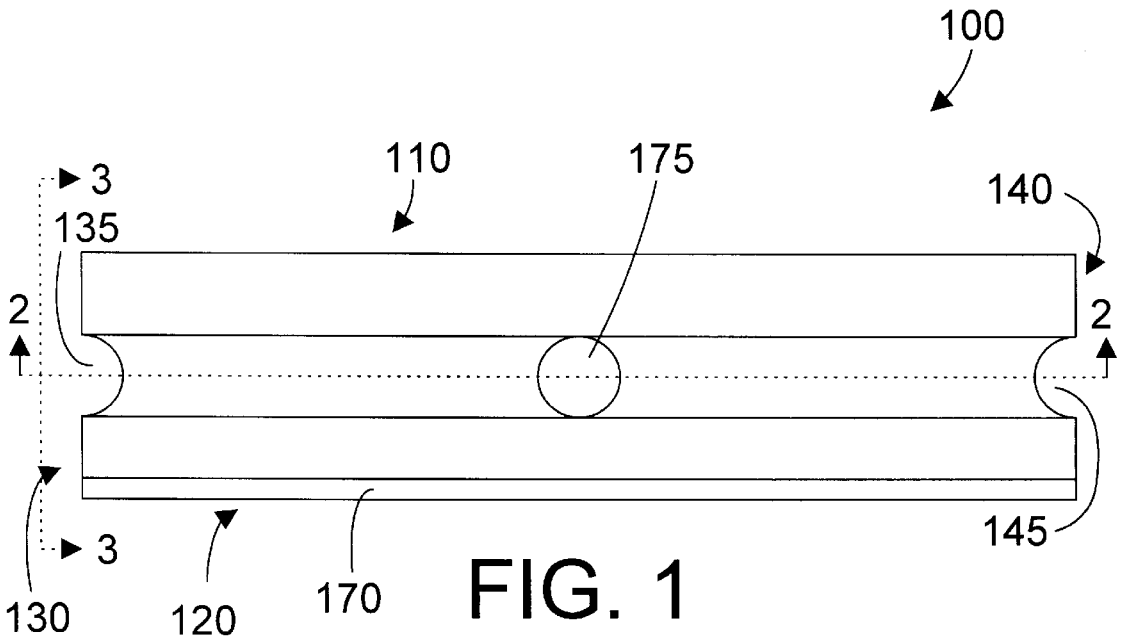
FIG. 1 is a top view of a building block in accordance with the present invention.
Figure 2:
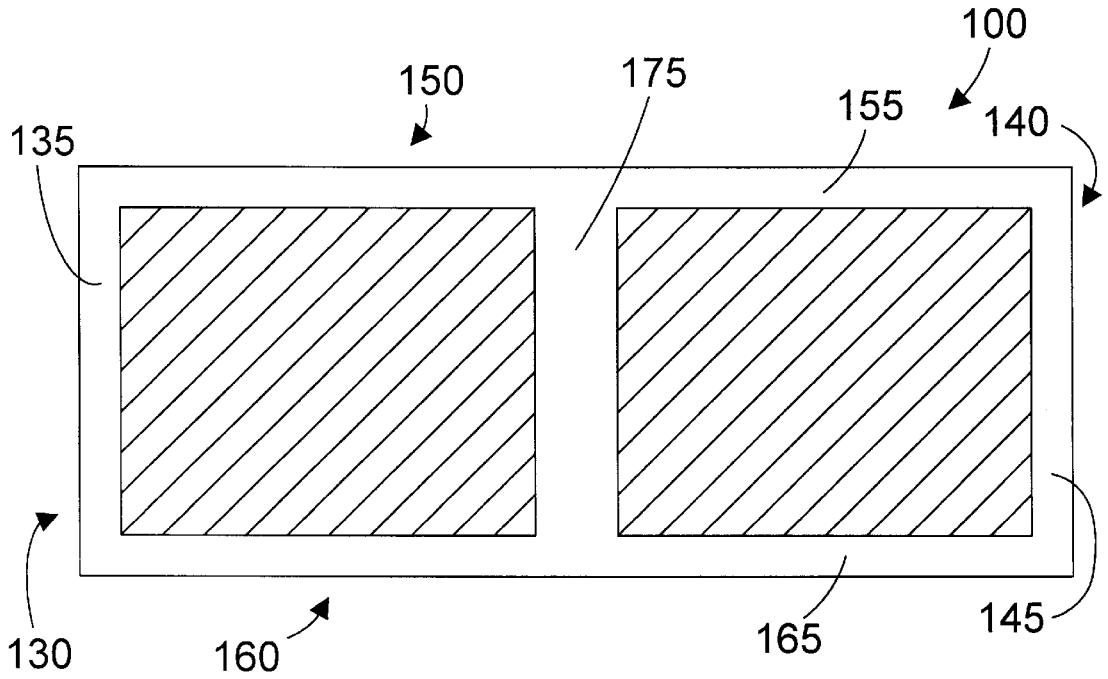
FIG. 2 is a cross-sectional view of the block of FIG. 1 taken along the lines 2—2.
Figure 3:
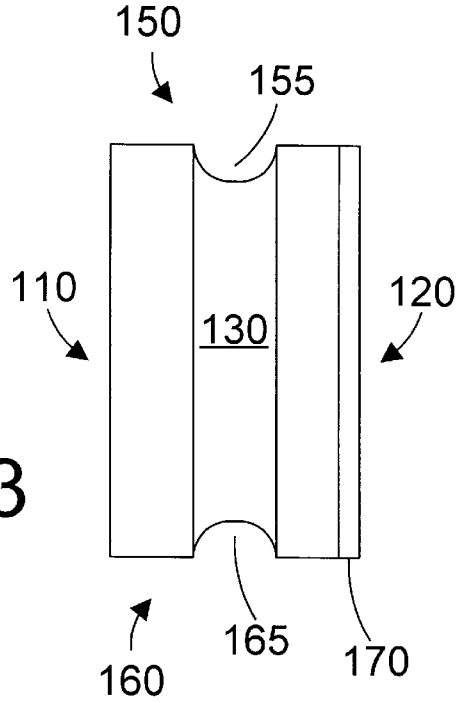
FIG. 3 is a side view of the block of FIG. 1 taken along the lines 3—3.
Figure 4:
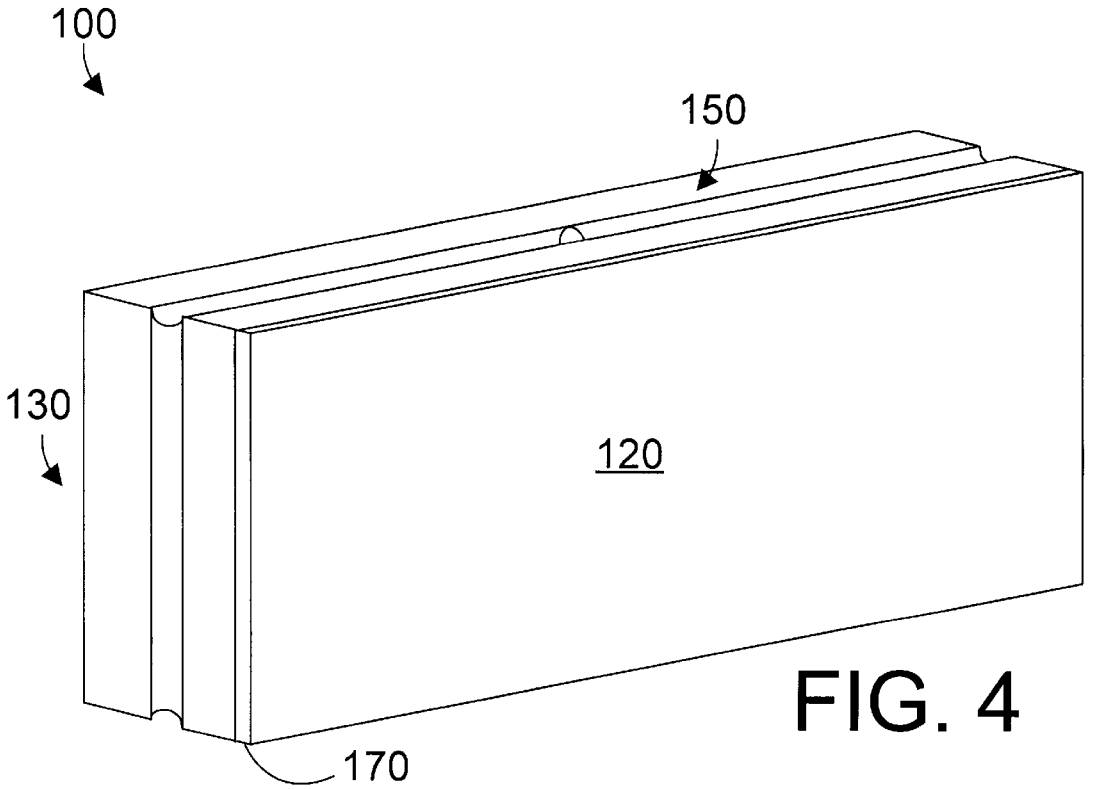
FIG. 4 is a perspective view of the block of FIG. 1.

Referring now to FIGS. 1–4, a building block 100 in accordance with the preferred embodiment includes a first exterior surface 110, a second exterior surface 120, a first side surface 130, a second side surface 140, a top surface 150, and a bottom surface 160. Either or both of the first exterior surface 110 and the second exterior surface 120 include an attachment layer 170. For purposes of illustrating the attachment layer 170 in the figures, attachment layer 170 in FIG. 1 is shown on exterior surface 120. Note, however, that attachment layer 170 may be located on either or both of the exterior surfaces 110 and 120.

Each of the side surfaces 130 and 140, the top surface 150, and the bottom surface 160 include corresponding substantially semi-cylindrical concave portions 135, 145, 155 and 165. In addition, block 100 further includes a cylindrical channel 175. These concave portions and cylindrical channel of one block align with similar concave portions and cylindrical channels on adjacent blocks to form a cross-linked structure of substantially cylindrical channels when the building blocks are assembled into a wall. These channels preferably have a circular cross-section, but may have other geometries within the scope of the present invention.

Block 100 is preferably comprised of a mixture of cement, water, and a suitable insulative material. The cement is preferably Portland cement, type 1, ASTM designation C150 or similar. The preferred insulative material is a synthetic bead material with a suitable diameter less than 2.54 cm (1 inch), a preferable diameter less than 1.27 cm (0.5 inch), and a most preferred diameter of 3.18 mm (⅛ inch) to 9.53 mm (⅜ inch). The insulative material may be any suitable insulative material, such as polyurethane, polycyanuarate, betostyrene, etc. The preferred insulative material is expanded polystyrene (EPS) foam beads. The best mode of the invention uses a mixture of different bead sizes ranging from 3.18 mm (⅛ inch) to 9.53 mm (⅜ inch). The proportions of water, cement, and EPS foam beads for the block mix are suitably 0.18 to 0.38 kilograms (kg) (0.4 to 0.8 lb) water to 0.35 to 0.59 l (12 to 20 dry ounces) cement to 1.8 to 4.1 l (60 to 140 dry ounces) EPS foam beads. The preferred proportions for the block are 0.23 to 0.32 kg (0.5 to 0.7 lb) water to 0.41 to 0.53 l (14 to 18 dry ounces) cement to 2.37 to 3.55 l (80 to 120 dry ounces) EPS foam beads. The proportions in accordance with the best mode of the invention for the block are most preferably 0.27 kg (0.6 lb) water to 0.47 l (16 dry ounces) cement to 2.96 l (100 dry ounces) EPS foam beads.

In the preferred embodiment, the attachment layer 170 has a composition that is different than the block material described above. The proportions of water, cement, and EPS foam beads for the attachment layer mix are suitably 0.18 to 0.32 kg (0.4 to 0.7 lb) water to 0.35 to 0.59 l (12 to 20 dry ounces) cement to 1.43 to 2.66 l (50 to 90 dry ounces) EPS foam beads. The preferred proportions of the attachment layer are 0.23 to 0.27 kg (0.5 to 0.6 lb) water to 0.41 to 0.53 l (14 to 18 dry ounces) cement to 1.77 to 2.37 l (60 to 80 dry ounces) EPS foam beads. The proportions in accordance with the best mode of the invention for the attachment layer are most preferably 0.25 kg (0.55 lb) water to 0.45 l (16 dry ounces) cement to 2.07 l (70 dry ounces) EPS foam beads. Formulating the attachment layer 170 according to the proportions above results in an attachment layer 170 that can receive and hold standard penetrating fasteners such as nails, screws, and staples.

Other items such as synthetic or natural materials may be added to attachment layer 170 to enhance its ability to hold fasteners. Suitable synthetic materials include fiberglass, kevlar, polypropylene, and metal wire, in any suitable form, including filaments, fibers, strands, fabrics, powders, etc. Suitable natural materials include cotton, hemp, flax, cellulose, animal hair, perlite, vermiculite, etc. The proportions of these materials depend on the characteristics of the specific material used and the desired holding strength for attachment layer 170. For the preferred embodiment, fiberglass strands (also known as glass fibers) are added to the preferred attachment layer mix, resulting in the following proportions: 0.25 kg (0.55 lb) water to 0.47 l (16 dry ounces) cement to 2.07 l (70 dry ounces) EPS foam beads to 0.030 l (1 dry ounce) fiberglass strands. The fiberglass strands are preferably alkali-resistant, and are preferably less than 3.18 mm (⅛ inch) in diameter and less than 2.54 cm (1 inch) in length.

In addition to adding synthetic or natural materials to attachment layer 170 as described above, the formulation of the attachment layer 170 may be improved by adding one or more admixtures to the attachment layer mix. Examples of suitable admixtures include air-entrainers (such as those compliant with ASTM C 260), bonders (such as latex, polyvinyl chloride, polyvinyl acetate, acrylics, or butadiene-styrene copolymers), plasticizers, superplasticizers, and the like. Many materials (such as those listed above) may improve the ability of attachment layer 170 to hold fasteners in place, and their addition to the mix for attachment layer 170 is within the scope of the present invention.

Note that the ranges specified herein are believed to be workable ranges for the various ingredients in the block mix and the attachment layer mix. However, it is possible that certain combinations within the ranges specified would not produce a block with the desired strength or an attachment layer with the desired holding power. Different formulations within the specified ranges are possible that will produce different properties of the resultant block and attachment layer.

Figure 6:
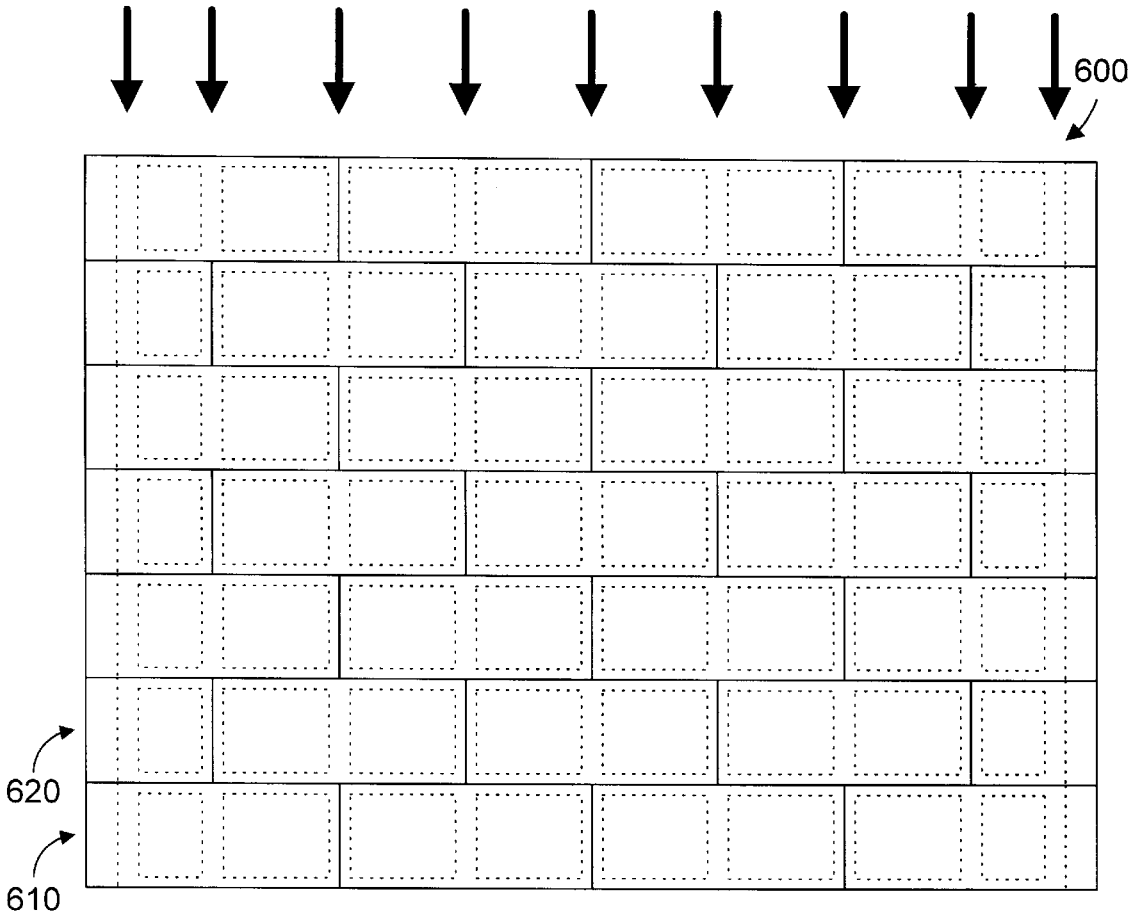
FIG. 6 is a front view of a block wall in accordance with the preferred embodiments.
Figure 7:
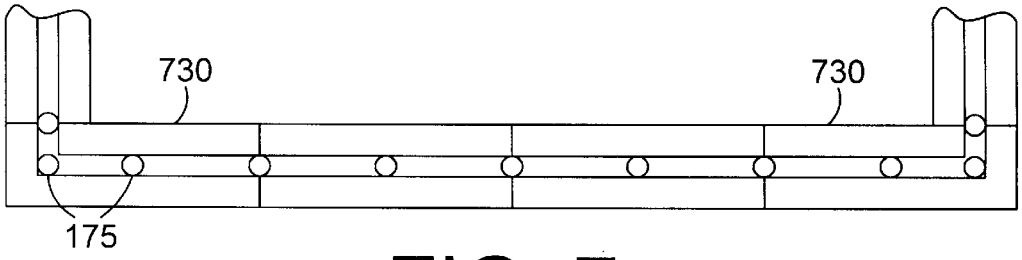
FIG. 7 is top view of the wall of FIG. 6.

Referring now to FIGS. 5–7, a method 500 for building a wall 600 using a plurality of blocks 100 begins by stacking the blocks (step 510). Block 100 is designed so that a wall is built by putting down a first course (or row) 610 of blocks end-to-end without mortar, then stacking the second course of blocks 620 on the first course of blocks without mortar in staggered fashion so that each block in the second course overlaps two blocks in the first course. Referring to FIGS. 1–4, with blocks 100 stacked to form a wall as shown in FIG. 6, the concave portions 135 and 145 of corresponding side portions 130 and 140 of a block in the course above are aligned above cylindrical channels 175 in the blocks below, and the concave portions 135 and 145 of corresponding side portions 130 and 140 of the lower blocks are aligned below the cylindrical channel 175 of the blocks above.

Note that if the blocks have a single attachment layer on one exterior surface (110 or 120), the attachment layer 170 of each block must be aligned with the side of the wall where the attachment layer is needed during the stacking of the blocks in step 510. Of course, if an attachment layer 170 is present on both exterior surfaces 110 and 120, no such alignment is required. In the preferred embodiment, the attachment layer is colored to provide a visible indication of where the attachment layer exists. One suitable method for coloring the attachment layer uses white cement to provide a contrast from the gray cement of the block mix. However, other methods of coloring or otherwise marking the attachment layer are within the scope of the invention.

During the stacking of the blocks 100, various items may be placed within the cross-linked structure of channels as required (step 520). For example, electrical cable, water and waste pipes, gas pipes, and reinforcing steel bar (known as rebar) may be put within the channels. These channels provide natural passageways for routing these items to their desired locations. Openings from the channels to the exterior of the block may be made using a drill, router, saw, or any other suitable tool to accommodate the exit points for plumbing, electrical wires, and the like.

Once two or more courses are stacked in place, with the desired rebar, cable, and/or pipes in place within the channels, a suitable filler material is then poured into the exposed openings at the top of the blocks (step 530). The preferred filler material is a cement-based grout that has a plastic consistency that allows it to flow by the force of gravity to fill all of the channels in the blocks. The grout material is referred to herein as a plastic material, not because the grout contains any plastic, but because the grout, when wet, has plastic properties. Suitable grout typically has a slump of 20.3–25.4 cm (8–10 inches). The best mode formulation for the grout is 298.5 kg (658 lb) cement to 170.1 kg (375 lb) water to 1,270 kg (2800 lb) aggregate, where the aggregate is preferably 75% sand and 25% pea gravel no greater than 1.3 cm (½ inch) in diameter. Note that the consistency of the filler material must allow the filler material to flow around all items located in the channels. Of course, many suitable filler materials other than grout may be used within the scope of the present invention. For example, a variety of injected foam, plastic, adhesive, or epoxy compounds would be suitable filler materials. In the preferred method of constructing a wall using blocks 100, the blocks for the entire wall are stacked in place (step 510) and all of the required items are routed in the channels (step 520) before the filler material is added (step 530). In this manner the filler material need only be poured once after all of the blocks for the wall are in place (as shown by the arrows in FIG. 6), rather than by pouring at different levels as the wall goes up.

Building a block wall 600 in accordance with method 500 requires corner blocks 730 that are different than the block 100 of FIG. 1 that is used in the middle of wall 600. These differences must be present to ensure that the resulting cross-linked structure of substantially cylindrical channels is closed within the wall 600 so that there is no open access from the channels to outside the wall, except for the openings at the top of the wall. A closed system will assure that no filler material that is poured into the network of channels will spill out. As a result, as the filler material fills the channels, the pressure from the material causes the filler material to fill the voids in the channels. As shown in FIG. 7, the semi-cylindrical concave portions of the corner blocks 730 do not extend from one side of the block to the other, but make a right-angle turn toward the adjacent wall. In addition, one or more extra cylindrical portions 175 may be present as required to lock together corner blocks with the other blocks 100 in the wall.

After the filler material is poured in place (step 530), it is allowed to harden and cure (step 540). Once the filler material has cured, any suitable surficial covering material may be attached to the exposed attachment layer 170 using any suitable fastener that at least partially penetrates attachment layer 170 (step 550). For example, if the interior side of an exterior wall 600 has an attachment layer 170, any suitable wall material (such as wallboard and paneling) may be directly nailed, stapled, or screwed to the attachment layer 170. Likewise, if the exterior side of an exterior wall has an attachment layer 170, any suitable exterior covering material (such as siding) may be directly nailed, stapled, or screwed to the attachment layer 170. Allowing a wall covering material to be directly fastened to wall 600 using standard fasteners eliminates the time and expense of furring out the walls with wood members. In addition, because attachment layer 170 is cement-based, stucco material may be placed directly onto attachment layer 170.

Figure 9:
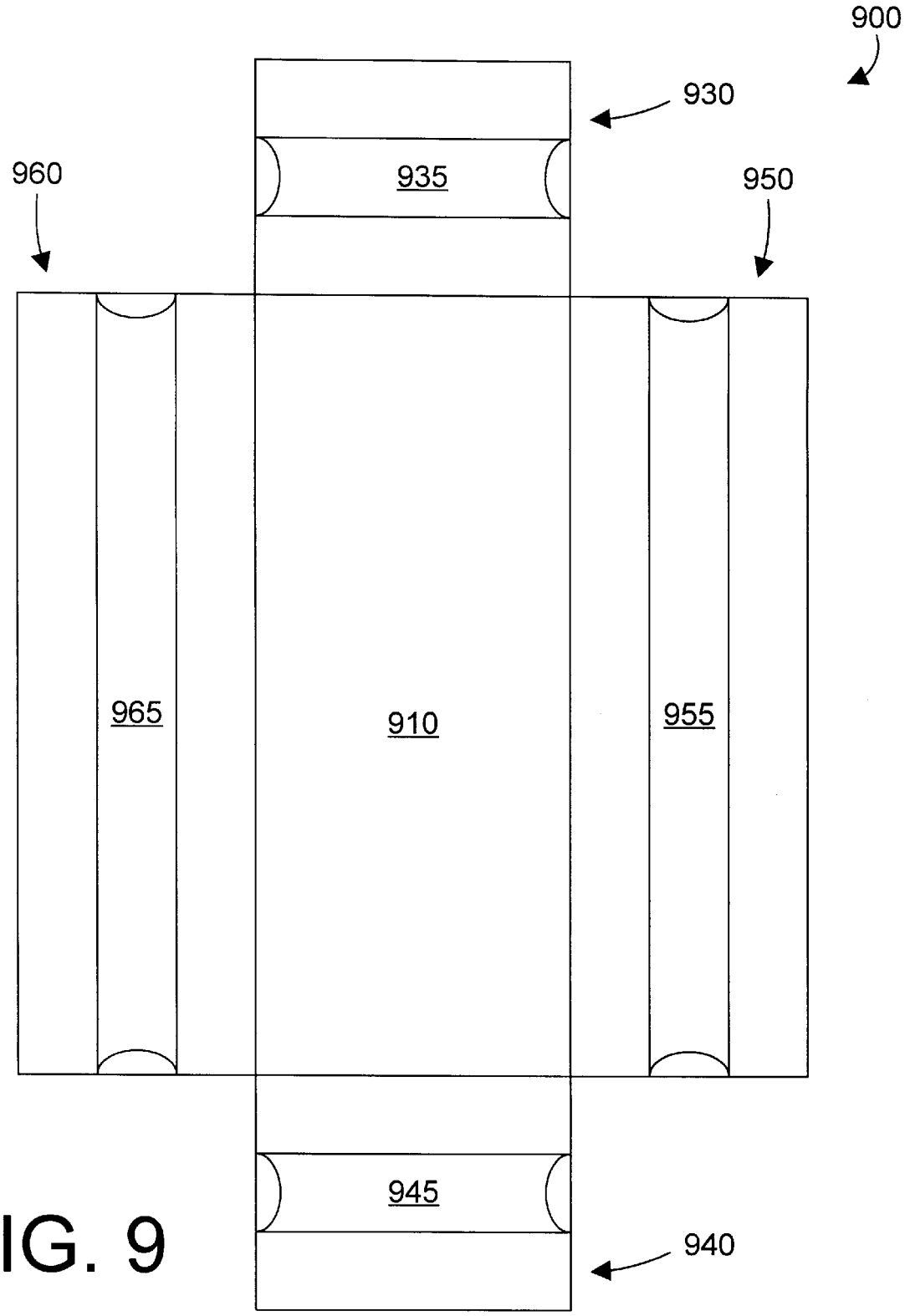
FIG. 9 is a top view of a form for forming the block of FIG. 1.

Referring now to FIGS. 8 and 9, a method 800 for forming a block 100 (of FIG. 1) uses a form 900. Form 900 has a bottom portion 910, and side portions 930, 940, 950 and 960 that are attached via a hinge mechanism to the bottom portion 910. Form 900 includes semi-cylindrical protrusions 935, 945, 955 and 965 that are attached to respective side portions 930, 940, 950 and 960. These protrusions are preferably made of a longitudinal bisection of circular pipe that is attached to each side portion. Each end of the protrusions are preferably mitered so that the protrusions fit together and align with each other when the form is assembled. Each side portion 930, 940, 950, and 960 with their corresponding semi-cylindrical protrusions 935, 945, 955 and 965 are used to create side portions 130, 140, 150 and 160 of block 100 with their corresponding semi-cylindrical concave portions 135, 145, 155 and 165. The bottom, side portions, and protrusions of form 900 are all preferably coated with a non-stick substance to ensure that the block does not stick to the form. Examples of suitable non-stick coatings include wax, form oil, teflon, etc.

The first step in method 800 is to assemble the form (step 810). The form is assembled by bringing each of the side portions 930, 940, 950 and 960 up so that each is perpendicular to the bottom portion 910. Each side portion is attached to the adjacent side portion to hold the form in place. Next, the material for the attachment layer 170 is poured into form 900 to a predetermined thickness (step 820). The material for the block is then poured on top of the attachment layer material (step 830). If a second attachment layer is desired on the block, block material is added to the form in step 830 until the level of the block material leaves a predetermined depth in the form for the second attachment layer. The material for the attachment layer is then added atop the block material (step 840) to create the second attachment layer, if desired.

Next the block is allowed to harden (step 850). For the preferred embodiments disclosed herein, the block is cement-based, and therefore hardens through hydration. Once the block has hardened, the form is disassembled and the block is removed from the form (step 860). The form is disassembled by placing the side portions 930, 940, 950 and 960 flat, as shown in FIG. 9. The block is then drilled to create center channel 175 (step 870), and the fabrication of the block is complete.

The specific embodiment of FIGS. 8 and 9 uses an open form, with the depth of the block being defined by the side portions of the form. Once the form is filled, excess is scraped off even with the side portions of the form. An alternative embodiment may include a lid that is placed atop the block mix or second attachment layer to give the surface of the block under the lid a smooth finish.

In the best mode of the invention, block 100 has a length of 122 centimeters (cm) (48 inches), a width of 24.1 cm (9.5 inches), and a height of 40.6 cm (16 inches). The diameter of the cylindrical channel 175 is 7.6 cm (3 inches), and the semi-cylindrical concave portions 135, 145, 155, and 165 each have a diameter of 7.6 cm (3 inches). The dimensions of block 100 allow a wall to be quickly and efficiently constructed, and the dimensions of the channels help assure that filler material will flow around any items (such as pipe, rebar, cables, etc.) that are placed within the channels.

While the invention has been particularly shown and described with reference to preferred embodiments thereof, it will be understood by those skilled in the art that various changes in form and details may be made therein without departing from the spirit and scope of the invention. For example, a block may be made entirely of attachment layer material rather than being made of a layered composition of different materials. The block may be made in a variety of different sizes. In addition, the size, number and geometries of the channels 175 and concave portions 135, 145, 155 and 165 may vary from that disclosed herein. In addition, while a method for forming the block 100 disclosed herein has a step for drilling out cylindrical channel 175 (step 870 of FIG. 8), this channel could also be formed during the fabrication of block 100 by inserting a pipe member into form 900 before pouring in the attachment layer mix and the block mix. This pipe member could be a pipe that remains in the block, or could be a pipe coated with a non-stick surface that is removed once the block is formed. In addition, while the preferred embodiment discloses forming the entire block by pouring one or more cement-based mixtures into a form, alternative embodiments may have surface layers of cement-based mixtures overlying other materials such as wood, foam, metal, plastic, or any other suitable construction material.

I claim:

1. A building block comprising:

a first exterior surface;

first and second side surfaces coupled to the first exterior surface;

a top surface coupled to the first exterior surface and to the first and second side surfaces;

a bottom surface coupled to the first exterior surface and to the first and second side surfaces;

a second exterior surface coupled to the first and second side surfaces, to the top surface, and to the bottom surface;

the first and second side surfaces, the top surface, and the bottom surface each comprising water, cement, and expanded polystyrene foam beads in first proportions;

at least one of the first and second exterior surfaces comprising an attachment layer comprising water, cement, and expanded polystyrene foam beads in second proportions different than the first proportions that permit the attachment layer to receive and hold a fastener that penetrates at least a portion of the attachment layer.

2. The building block of claim 1 wherein the expanded polystyrene foam beads have a diameter from 3.18 mm (⅛ inch) to 9.53 mm (⅜ inch).

3. The building block of claim 1 wherein the second proportions of water, cement, and expanded polystyrene foam beads comprise:

approximately 0.25 kg (0.55 lb) water;

approximately 0.47 l (16 dry ounces) cement; and approximately 2.07 l (70 dry ounces) expanded polystyrene foam beads.

4. The building block of claim 3 wherein the second proportions further comprise 0.030 l (1 dry ounce) fiberglass strands.

5. The building block of claim 1 wherein the attachment layer further comprises fibers.

6. The building block of claim 5 wherein the fibers comprise fiberglass.

7. The building block of claim 1 wherein the second proportions of water, cement, and expanded polystyrene foam beads comprise:

from 0.23 to 0.27 kg (0.5 to 0.6 lb) water;

from 0.41 to 0.53 l (14 to 18 dry ounces) cement; and from 1.77 to 2.37 l (60 to 80 dry ounces) expanded polystyrene foam beads.

8. The building block of claim 1 wherein the second proportions of water, cement, and expanded polystyrene foam beads comprise:

from 0.18 to 0.32 kg (0.4 to 0.7 lb) water;

from 0.35 to 0.59 l (12 to 20 dry ounces) cement; and from 1.43 to 2.66 l (50 to 90 dry ounces) expanded polystyrene foam beads.

9. The building block of claim 1 wherein:

each first and second side surface comprises a substantially semi-cylindrical concave portion;

the top surface comprises a substantially semi-cylindrical concave portion; and the bottom surface comprises a substantially semi-cylindrical concave portion;

the substantially semi-cylindrical concave portions forming a cross-linked structure of substantially cylindrical channels when a plurality of building blocks are assembled into a wall.

10. The building block of claim 9 wherein the substantially semi-cylindrical concave portion of the first and second side surfaces each extend from the top surface to the bottom surface.

11. The building block of claim 9 wherein the substantially semi-cylindrical concave portion of the top surface extends between the first and second side surfaces.

12. The building block of claim 9 wherein the substantially semi-cylindrical concave portion of the bottom surface extends between the first and second side surfaces.

13. The building block of claim 9 further comprising at least one substantially cylindrical channel extending between the top surface and the bottom surface.

14. The building block of claim 1 wherein the first proportions of water, cement, and expanded polystyrene foam beads comprise:

approximately 0.27 kg (0.6 lb) water;

approximately 0.47 l (16 dry ounces) cement; and approximately 2.96 l (100 dry ounces) expanded polystyrene foam beads.

15. The building block of claim 1 wherein the first proportions of water, cement, and expanded polystyrene foam beads comprise:

from 0.23 to 0.32 kg (0.5 to 0.7 lb) water;

from 0.41 to 0.53 l (14 to 18 dry ounces) cement; and from 2.37 to 3.55 l (80 to 120 dry ounces) expanded polystyrene foam beads.

16. The building block of claim 1 wherein the first proportions of water, cement, and expanded polystyrene foam beads comprise:

from 0.18 to 0.38 kg (0.4 to 0.8 lb) water;

from 0.35 to 0.59 l (12 to 20 dry ounces) cement; and from 1.8 to 4.1 l (60 to 140 dry ounces) expanded polystyrene foam beads.

17. A building block comprising:

a first exterior surface;

first and second side surfaces coupled to the first exterior surface, each first and second side surface comprising a substantially semi-cylindrical concave portion;

a top surface coupled to the first exterior surface and to the first and second side surfaces, the top surface comprising a substantially semi-cylindrical concave portion extending between the first and second side surfaces;

a bottom surface coupled to the first exterior surface and to the first and second side surfaces, the bottom surface comprising a substantially semi-cylindrical concave portion extending between the first and second side surfaces;

a second exterior surface coupled to the first and second side surfaces, to the top surface, and to the bottom surface;

at least one substantially cylindrical channel extending between the top surface and the bottom surface;

each of the first and second side surfaces and the top and bottom surfaces comprising:

approximately 0.27 kg (0.6 lb) water;

approximately 0.47 l (16 dry ounces) cement; and approximately 2.96 l (100 dry ounces) expanded polystyrene foam beads with a diameter from 3.18 mm (⅛ inch) to 9.53 mm (⅜ inch);

at least one of the first and second exterior surfaces comprising an attachment layer for receiving and holding a fastener that penetrates at least a portion of the attachment layer, the attachment layer comprising:

approximately 0.25 kg (0.55 lb) water;

approximately 0.47 l (16 dry ounces) cement;

approximately 2.07 l (70 dry ounces) expanded polystyrene foam beads with a diameter from 3.18 mm (⅛ inch) to 9.53 mm (⅜ inch); and 0.030 l (1 dry ounce) fiberglass strands.

* * * * *